US012595568B2

(12) United States Patent
Kimura et al.

(10) Patent No.: US 12,595,568 B2
(45) Date of Patent: Apr. 7, 2026

(54) ETCHANT COMPOSITION

(71) Applicant: Kao Corporation, Tokyo (JP)

(72) Inventors: Yosuke Kimura, Wakayama (JP); Shota Okazaki, Wakayama (JP)

(73) Assignee: KAO CORPORATION, Tokyo (JP)

( * ) Notice: Subject to any disclaimer, the term of this patent is extended or adjusted under 35 U.S.C. 154(b) by 258 days.

(21) Appl. No.: 18/281,102

(22) PCT Filed: Oct. 15, 2021

(86) PCT No.: PCT/JP2021/038231
§ 371 (c)(1),
(2) Date: Sep. 8, 2023

(87) PCT Pub. No.: WO2022/190448
PCT Pub. Date: Sep. 15, 2022

(65) Prior Publication Data

US 2024/0295030 A1 Sep. 5, 2024

(30) Foreign Application Priority Data

Mar. 10, 2021 (JP) ..... 2021-038475
Oct. 13, 2021 (JP) ..... 2021-167898

(51) Int. Cl.
*C23F 1/16* (2006.01)
*C23F 11/14* (2006.01)

(52) U.S. Cl.
CPC ..... *C23F 1/16* (2013.01); *C23F 11/146* (2013.01)

(58) Field of Classification Search
CPC .. C23F 1/16; C23F 11/146; C23F 1/20; C23F 1/30; C23F 1/18; C23F 1/28; C23F 1/26; C23F 11/141; H01L 21/306; H01L 21/308; H01L 21/30604
USPC ..... 252/79.1–79.4
See application file for complete search history.

(56) References Cited

U.S. PATENT DOCUMENTS

2014/0141616 A1* 5/2014 Bae ..... H01L 21/32134 438/694
2016/0083650 A1* 3/2016 Sugishima ..... H01L 21/32134 252/79.3
2019/0198392 A1 6/2019 Mullick et al.
2019/0284704 A1* 9/2019 Ge ..... H01L 21/32134
2019/0301026 A1 10/2019 Kouno et al.
2019/0301028 A1 10/2019 Chen
2020/0279752 A1* 9/2020 Honda ..... H01L 21/67086

FOREIGN PATENT DOCUMENTS

JP 2009-76910 A 4/2009
JP 2012-49535 A 3/2012
JP 2013-237873 A 11/2013
JP 2015-144230 A 8/2015
JP 2018-6715 A 1/2018
JP 2018-49992 A 3/2018
JP 2019-114791 A 7/2019
JP 2019-165225 A 9/2019
JP 2020-145412 A 9/2020
KR 10-2014-0065771 A 5/2014
KR 10-2018-0110760 A 10/2018

OTHER PUBLICATIONS

International Search Report (PCT/ISA/210) issued in PCT/JP2021/038231, dated Jan. 11, 2022.

* cited by examiner

*Primary Examiner* — Duy Vu N Deo
(74) *Attorney, Agent, or Firm* — Birch, Stewart, Kolasch & Birch, LLP

(57) ABSTRACT

In one aspect, provided is an etchant composition that is able to reduce etching nonuniformity.
An aspect of the present disclosure relates to an etchant composition for etching of a layer to be etched that contains at least one metal. The etchant composition contains an etching inhibitor, an acid including at least a nitric acid, and water and has a pH of 1 or less. The etching inhibitor is at least one nitrogen-containing compound selected from the group consisting of polyalkyleneimine and a polymer having a constitutional unit derived from diallylamine.

9 Claims, No Drawings

ETCHANT COMPOSITION

TECHNICAL FIELD

The present disclosure relates to an etchant composition and an etching method using the etchant composition.

BACKGROUND ART

The manufacturing process of a semiconductor device includes a step of etching a layer to be etched to form a predetermined pattern. The layer to be etched contains at least one metal selected from, e.g., tungsten, tantalum, zirconium, hafnium, molybdenum, niobium, ruthenium, osmium, rhenium, rhodium, copper, nickel, cobalt, titanium, titanium nitride, alumina, aluminum, or iridium.

In the field of semiconductor, wiring has been required to be finer and more complicated due to a high level of integration in recent years. There is also a growing demand for patterning technology and etchants, and various etching methods have been proposed (Patent Documents 1 to 3).

For example, JP 2018-6715 A (Patent Document 1) proposes a method for batch etching of a tungsten film and a titanium nitride film using an etchant composition that contains a nitric acid and water.

JP 2019-114791 A (Patent Document 2) proposes a method for etching of a tungsten layer using hydrogen peroxide and one of a strong acid or a strong base.

KR 10-2014-0065771 A (Patent Document 3) proposes a method for batch etching of a tungsten film and a titanium nitride film using hydrogen peroxide, a phosphoric acid, and an amine or amide polymer.

DISCLOSURE OF INVENTION

An aspect of the present disclosure relates to an etchant composition for etching of a layer to be etched that contains at least one metal. The etchant composition contains an etching inhibitor, an acid including at least a nitric acid, and water and has a pH of 1 or less. The etching inhibitor is at least one nitrogen containing compound selected from the group consisting of polyalkyleneimine and a polymer having a constitutional unit derived from diallylamine.

An aspect of the present disclosure relates to an etchant composition for an etching treatment of a layer to be etched that contains at least one metal. The etchant composition contains an etching inhibitor, an acid including a phosphoric acid, an acetic acid, and a nitric acid, and water and has a pH of 1 or less. The etching inhibitor is a nitrogen-containing compound with a percentage of etching inhibition of 30% or more, which is determined under the following conditions.

The percentage of etching inhibition is calculated by subtracting a relative rate A from 100, where the relative rate A is obtained by determining an etching rate measured using the etchant composition with respect to an etching rate measured using a mixed acid aqueous solution, which is taken as 100; the mixed acid aqueous solution consists of a phosphoric acid, an acetic acid, a nitric acid, and water a mass ratio of the added amounts of the phosphoric acid, the acetic acid, and the nitric acid in the mixed acid aqueous solution is the same as that of the added amounts of the phosphoric acid, the acetic acid, and the nitric acid in the etchant composition: the total added amount of the phosphoric acid, the acetic acid, and the nitric acid in the mixed acid aqueous solution is 86% by mass; and the mixed acid aqueous solution is used for etching at a predetermined temperature for a predetermined time so that the etching rate is measured.

An aspect of the present disclosure relates to an etchant composition for an etching treatment of a layer to be etched that contains at least one metal. The etchant composition contains an etching inhibitor, an acid including at least a nitric acid, and water and has a pH of 1 or less. The etching inhibitor is a nitrogen-containing compound that can maintain a zeta potential of a surface of the at least one metal contained in the layer to be etched at a value of more than 0 m V and 50 mV or less.

An aspect of the present disclosure relates to an etching method that includes etching a layer to be etched that contains at least one metal with the etchant composition of the present disclosure.

DESCRIPTION OF THE INVENTION

In the conventional etching methods, a layer to be etched that contains metals such as tungsten is excessively etched, which may result in nonuniform etching. In particular, the manufacturing process of semiconductor wafers requires an etchant that is less likely to cause etching nonuniformity in terms of productivity and yield.

With the foregoing in mind, in one aspect, the present disclosure provides an etchant composition that is able to reduce etching nonuniformity, and an etching method using the etchant composition.

In one aspect, the present disclosure can provide the etchant composition that is able to reduce etching nonuniformity.

In one aspect, the present disclosure is based on the findings that the use of an etchant that contains an acid including at least a nitric acid, an etching inhibitor, and water can decrease the etching rate and reduce etching nonuniformity.

In one aspect, the present disclosure relates to an etchant composition (also referred to as an "etchant composition of the present disclosure" in the following) for etching of a layer to be etched that contains at least one metal. The etchant composition contains an etching inhibitor, an acid including at least a nitric acid, and water and has a pH of 1 or less. The etching inhibitor is at least one nitrogen-containing compound selected from the group consisting of polyalkyleneimine and a polymer having a constitutional unit derived from diallylamine. The etchant composition of the present disclosure is able to reduce etching nonuniformity.

The details of the mechanism of the effect of the present disclosure are not fully clear, but can be assumed as follows.

The percentage of etching inhibition tends to be high when the surface of a layer to be etched is covered densely or when a thick protective film is formed on the surface of the layer to be etched.

In the present disclosure, a specific nitrogen-containing compound that serves as an etching inhibitor is selectively adsorbed on the layer to be etched. Therefore, the surface of the layer can be protected and gently etched, thereby reducing etching nonuniformity.

Moreover, the zeta potential of the surface of a metal contained in the layer to be etched is a negative value under acidic conditions, while the nitrogen containing compound that serves as an etching inhibitor has a positive charge under the acidic conditions. This facilitates the selective adsorption of the nitrogen-containing compound on the layer to be etched. Consequently, in the present disclosure, the specific nitrogen-containing compound protects the surface of the metal contained in the layer to be etched so that the layer is gently etched. Thus, etching nonuniformity can be reduced.

In the conventional etching using hydrogen peroxide, metals contained in the layer to be etched are susceptible to oxidation, and multiple types of oxides of these metals are likely to be generated. Accordingly, nonuniform etching can occur easily. Further, it is difficult to form a protective film on the surface of the metal contained in the layer to be etched by using a nitrogen-containing compound (e.g., polyalkylene polyamine) other than the etching inhibitor of the present disclosure. This may also lead to etching nonuniformity.

However, the present disclosure should not be interpreted solely by the above mechanism.

[Etching Inhibitor]

The etchant composition of the present disclosure may contain only one type of etching inhibitor or two or more types of etching inhibitors.

In the present disclosure, the percentage of etching inhibition of the etching inhibitor is preferably 20% or more, more preferably 30% or more, even more preferably 40% or more, still more preferably 50% or more, yet more preferably 60% or more, further preferably 70% or more, even further preferably 80% or more, still further preferably 85% or more, yet further preferably 90% or more, and much more preferably 94% or more from the viewpoint of reducing etching nonuniformity.

In the present disclosure, the percentage of etching inhibition means the rate of decrease in the etching rate with the use of the etching inhibitor relative to the etching rate without the use of the etching inhibitor. In one or more embodiments, the percentage of etching inhibition can be calculated by subtracting a relative rate A from 100, where the relative rate A is obtained by determining the etching rate measured using the etchant composition with respect to the etching rate measured using a mixed acid aqueous solution, which is taken as 100. The mixed acid aqueous solution consists of a phosphoric acid, an acetic acid, a nitric acid, and water. The mass ratio of the added amounts of the phosphoric acid, the acetic acid, and the nitric acid in the mixed acid aqueous solution is the same as that of the added amounts of the phosphoric acid, the acetic acid, and the nitric acid in the etchant composition. The total added amount of the phosphoric acid, the acetic acid, and the nitric acid in the mixed acid aqueous solution is 86% by mass. The mixed acid aqueous solution is used for etching at a predetermined temperature for a predetermined time so that the etching rate is measured. The mass ratio of the added amounts of the components in the mixed acid aqueous solution may be appropriately determined. In one or more embodiments, the percentage of etching inhibition may be measured by adjusting the operating conditions such as temperature and time according to the etching conditions. The measurement conditions of the percentage of etching inhibition vary depending on the metal contained in the layer to be etched. In one or more embodiments, the preferred ranges of the temperature and the time for measuring the percentage of etching inhibition may be the same as the preferred ranges of the etching temperature and the etching time in the etching process of the present disclosure, as will be described later. For example, a predetermined temperature and a predetermined time for measuring the percentage of etching inhibition may be 90° C. and 120 minutes when a metal plate used in the measurement is a tungsten plate or a titanium plate, and may be 40° C. and 10 minutes when the metal plate is a molybdenum plate, a nickel plate, a cobalt plate, or a copper plate. The metal plate may be, e.g., in the form of a plate of 2 cm long 2 cm wide, and 0.1 mm thick. Specifically, the percentage of etching inhibition can be measured by a method as described in Examples.

In one or more embodiments, the etching inhibitor of the present disclosure is preferably a nitrogen-containing compound with a percentage of etching inhibition of 30% or more, which is determined under the above conditions, from the viewpoint of reducing etching nonuniformity.

Thus, in one aspect, the present disclosure relates to an etchant composition for an etching treatment of a layer to be etched that contains at least one metal. The etchant composition contains an etching inhibitor, an acid including a phosphoric acid, an acetic acid, and a nitric acid, and water and has a pH of 1 or less. The etching inhibitor is a nitrogen-containing compound with a percentage of etching inhibition of 30% or more, which is determined under the above conditions.

In one or more embodiments, the etching inhibitor of the present disclosure is at least, one nitrogen-containing compound selected from the group consisting of polyalkyleneimine and a polymer having a constitutional unit derived from diallylamine. The polyalkyleneimine may be, e.g., polyethyleneimine. The polymer having a constitutional unit derived from diallylamine may be, e.g., a diallylamine/sulfur dioxide copolymer.

Among them, in one or more embodiments, the etching inhibitor is preferably polyalkyleneimine, and more preferably polyethyleneimine from the viewpoint of reducing etching nonuniformity. The polyalkyleneimine such as polyethyleneimine makes it easy to form a protective film on the surface of the metal contained in the layer to be etched, can prevent both oxidation of the metal contained in the layer to be etched and dissolution of an oxide of the metal, and thus can suitably inhibit etching.

In one or more embodiments, the average molecular weight of the etching inhibitor is preferably 300 or more, and also preferably 100,000 or less from the viewpoint of further reducing etching nonuniformity.

When the etching inhibitor is polyalkyleneimine, in one or more embodiments the number average molecular weight of the etching inhibitor is preferably 300 or more, more preferably 600 or more, and further preferably 1,200 or more from the viewpoint of further reducing etching nonuniformity. Furthermore, the number average molecular weight of the etching inhibitor is preferably 100.000 or less, more preferably 5,000 or less, and further preferably 3,000 or less from the viewpoint of viscosity. More specifically, the number average molecular weight of the etching inhibitor is preferably 300 or more and 100,000 or less, more preferably 600 or more and 5,000 or less, and further preferably 1,200 or more and 3,000 or less.

When the etching inhibitor is a polymer having a constitutional unit derived from diallylamine, in one or more embodiments, the weight average molecular weight of the etching inhibitor is preferably 2.000 or more, more preferably 3.000 or more, and further preferably 4,000 or more from the viewpoint of further reducing etching nonuniformity. Furthermore, the weight average molecular weight of the etching inhibitor is preferably 50.000 or less, more preferably 10,000 or less, and further preferably 7,000 or less. More specifically, the weight average molecular weight of the etching inhibitor is preferably 2,000 or more and 50,000 or less, more preferably 3,000 or more and 10,000 or less, and further preferably 4,000 or more and 7,000 or less.

In the present disclosure, the average molecular weight may be measured by gel permeation chromatography (GPC) under the following conditions.

<GPC Conditions (Polyalkyleneimine)>

Sample solution: solution adjusted to a concentration of 0.1 wt %

Device/Detector: HLC-8320GPC (integrated GPC) manufactured by Tosoh Corporation

Column: α–M+α–M (manufactured by Tosoh Corporation)

Eluent: 0.15 mol/L $Na_2SO_4$ 1% $CH_3COOH$/water

Column temperature: 40° C.

Flow rate: 1.0 ml/min

Injection volume of sample solution: 100 μL

Standard polymer: pullulan with a known molecular weight (P-5, P-50, P-200, and P-800 by Shodex)

<GPC Conditions (Polymer Having Constitutional Unit Derived from Diallylamine)>

Sample solution: solution adjusted to a concentration of 0.1 wt %

Detector: HILC-8320GPC (integrated GPC) manufactured by Tosoh Corporation

Column: α–M+a–M (manufactured by Tosoh Corporation)

Eluent: 0.15 mol/L $Na_3SO_4$, 1% $CH_3COOH$/water

Column temperature: 40° C.

Flow rate: 1.0 ml/min.

Injection volume of sample solution: 100 μL

Standard polymer: pullulan with a known molecular weight (P-5, P-50, P-200, and P-800 by Shodex)

In one or more embodiments, it is preferable, from the viewpoint of reducing etching nonuniformity, that the etching inhibitor of the present disclosure is at least one nitrogen-containing compound selected from the group consisting of polyalkyleneimine and a polymer having a constitutional unit derived from diallylamine, and that the at least one nitrogen-containing compound has a percentage of etching inhibition of 30% or more, which is determined under the above conditions.

Thus, in one aspect, the present disclosure relates to an etchant composition for etching of a layer to be etched that contains at least one metal. The etchant composition contains an etching inhibitor, an acid including at least a nitric acid, and water and has a pH of 1 or less. The etching inhibitor is at least one nitrogen-containing compound selected from the group consisting of polyalkyleneimine and a polymer having a constitutional unit derived from diallylamine, and the at least one nitrogen-containing compound has a percentage of etching inhibition of 30% or more, which is determined under the above conditions.

In one or more embodiments, the etching inhibitor of the present disclosure is preferably a nitrogen-containing compound that can maintain the zeta potential of the surface of the metal contained in the layer to be etched at a value of more than 0 mV and 50 mV or less from the viewpoint of reducing etching nonuniformity. The zeta potential of the surface of the metal is preferably more than 0 mV, more preferably 10 m V or more, and further preferably 20 mV or more from the viewpoint of reducing etching nonuniformity. The zeta potential of the surface of the metal may be 50 mV or less, 40 mV or less, or 35 m V or less.

Thus, in one aspect, the present disclosure relates to an etchant composition for an etching treatment of a layer to be etched that contains at least one metal. The etchant composition contains an etching inhibitor, an acid including at least a nitric acid, and water and has a pH of 1 or less. The etching inhibitor is a nitrogen-containing compound that can maintain a zeta potential of a surface of the at least one metal contained in the layer to be etched at a value of more than 0 m V and 50 mV or less.

In the present disclosure, the zeta potential of the surface of the metal contained in the layer to be etched is a negative value under acidic conditions, while the nitrogen containing compound that serves as an etching inhibitor has a positive charge under the acidic conditions. This facilitates the selective adsorption of the nitrogen containing compound on the layer to be etched. Therefore, when the etchant composition of the present disclosure is used to etch the layer to be etched, the zeta potential of the surface of the metal contained in the layer to be etched is changed to a positive value. Such a change in the value of the zeta potential confirms that the etching inhibitor has been adsorbed on the surface of the metal. Thus, the surface of the metal is protected by the etching inhibitor and gently etched, so that etching nonuniformity can be reduced.

The blending amount of the etching inhibitor in the etchant composition of the present disclosure is preferably 0.01% by mass or more, more preferably 0.1% by mass or more, and further preferably 0.5% by mass or more from the viewpoint of reducing etching nonuniformity. From the same viewpoint, the blending amount of the etching inhibitor is preferably 10% by mass or less, more preferably 5% by mass or less, and further preferably 3% by mass or less. More specifically, the blending amount of the etching inhibitor is preferably 0.01% by mass or more and 10% by mass or less, more preferably 0.1% by mass or more and 5% by mass or less and further preferably 0.5% by mass or more and 3% by mass or less. When the etching inhibitor is a combination of two or more types, the blending amount of the etching inhibitor is the total amount of the two or more types.

[Acid]

The acid contained in the etchant composition of the present disclosure includes at least a nitric acid from the viewpoint of uniform etching of the layer to be etched. The acid may be used alone (i.e., only the nitric acid) or in combination of two or more.

In one or more embodiments, the acid of the present disclosure may further include at least one selected from the group consisting of a phosphoric acid and an organic acid other than the nitric acid from the viewpoint of reducing etching nonuniformity. Examples of the organic acid include at least one selected from the following: formic acid; acetic acid; propionic acid; butyric acid; oxalic acid: malonic acid: succinic acid: glutaric acid; adipic acid: pimelic acid; maleic acid: fumaric acid; phthalic acid: trimellitic acid; hydroxyacetic acid lactic acid: salicylic acid; malic acid; tartaric acid citric acid: aspartic acid; and glutamic acid. In one or more embodiments, the acid of the present disclosure may further include at least one selected from the group consisting of a phosphoric acid and an acetic acid other than the nitric acid from the viewpoint of reducing etching nonuniformity. In one or more embodiments, the acid may be, e.g., an acid including a phosphoric acid, an acetic acid, and a nitric acid. In one or more embodiments, the acid may be, e.g., a mixed acid consisting of a phosphoric acid, an acetic acid, and a nitric acid.

When the acid of the present disclosure is a mixed acid consisting of a phosphoric acid, an acetic acid, and a nitric acid, the added amount of the phosphoric acid in the mixed acid is preferably 50% by mass or more and 95% by mass or less, more preferably 55% by mass or more and 93% by mass or less, and further preferably 60% by mass or more and 90% by mass or less from the viewpoint of reducing etching nonuniformity. From the same viewpoint, the added amount of the acetic acid in the mixed acid is preferably 2% by mass or more and 80% by mass or less, more preferably 3% by mass or more and 70% by mass or less, and further preferably 5% by mass or more and 60% by mass or less. From the same viewpoint, the added amount of the nitric acid in the mixed acid is preferably 0.5% by mass or more and 20% by mass or less more preferably 1% by mass or more and 15% by mass or less, and further preferably 1.5% by mass or more and 10% by mass or less. The mass ratio of the phosphoric acid, the acetic acid, and the nitric acid (phosphoric acid/acetic acid/nitric acid) can be appropriately determined and may be, e.g., 88/8/4. In one or more embodiments the added amount of each component in the mixed acid may be considered as the content of each component in the mixed acid.

When the acid of the present disclosure includes at least a nitric acid, the added amount of the nitric acid in the etchant composition is preferably 0.5% by mass or more and 20% by mass or less, more preferably 1% by mass or more and 10% by mass or less, and further preferably 1.5% by mass or more and 5% by mass or less.

The blending amount of the acid in the etchant composition of the present disclosure is preferably 70% by mass or more, more preferably 75% by mass or more, and further preferably 80% by mass or more from the viewpoint of reducing etching nonuniformity. From the same viewpoint, the blending amount of the acid is preferably 98% by mass or less, more preferably 95% by mass or less, and further preferably 90% by mass or less. More specifically, the blending amount of the acid is preferably 70% by mass or more and 98% by mass or less, more preferably 75% by mass or more and 95% by mass or less, and further preferably 80% by mass or more and 90% by mass or less. When the acid is a combination of two or more types, the blending amount of the acid is the total amount of the two or more types.

[Water]

In one or more embodiments, the etchant composition of the present disclosure contains water. The water contained in the etchant composition may be, e.g., distilled water, ion-exchanged water, pure water, or ultrapure water.

The blending amount of the water in the etchant composition of the present disclosure is preferably 2% by mass or more, more preferably 5% by mass or more, and further preferably 7% by mass or more from the viewpoint of reducing etching nonuniformity. From the same viewpoint, the blending amount of the water is preferably 30% by mass or less, more preferably 25% by mass or less, and further preferably 20% by mass or less. More specifically, the blending amount of the water is preferably 2% by mass or more and 30% by mass or less, more preferably 5% by mass or more and 25% by mass or less, and further preferably 7% by mass or more and 20% by mass or less.

[Other Components]

The etchant composition of the present disclosure may further contain other components to the extent that they do not interfere with the effects of the present disclosure. The other components include, e.g., a chelating agent, a surface-active agent, a solubilizing agent, an antiseptic, an anticorrosive, a bactericide, an antibacterial agent, and an antioxidant.

It is preferable that the etchant composition of the present disclosure does not contain hydrogen peroxide from the viewpoint of reducing etching nonuniformity. In the context of the present disclosure, in one or more embodiments, the phrase "not contain hydrogen peroxide" may mean any of the following: (i) the etchant composition does not contain hydrogen peroxide; (ii) the etchant composition does not substantially contain hydrogen peroxide; and (iii) the etchant composition does not contain an amount of hydrogen peroxide that affects the etching results. Specifically, the blending amount of hydrogen peroxide in the etchant composition of the present disclosure is not particularly limited, and is preferably 3% by mass or less, more preferably 1% by mass or less, even more preferably 0.1% by mass or less, still more preferably 0.01% by mass or less, yet more preferably 0.001% by mass or less, and further preferably 0% by mass.

[Production Method of Etchant Composition]

In one aspect, the etchant composition of the present disclosure can be produced by blending an etching inhibitor, an acid including a nitric acid, and water, and the optional components as desired, with a known method. Thus, in one aspect, the present disclosure relates to a method for producing an etchant composition (also referred to as a "production method of an etchant of the present disclosure" in the following). The production method of an etchant of the present disclosure includes blending at least an etching inhibitor, an acid including a nitric acid, and water.

In the context of the present disclosure, in one or more embodiments, the phrase "blending at least an etching inhibitor, an acid including a nitric acid, and water" may include mixing the etching inhibitor, the acid including a nitric acid, and water, and the optional components as needed, simultaneously or in sequence. They can be mixed in any order. The blending can be performed, e.g., with a propeller agitator, liquid circulation stirring using a pump, and a mixer such as a homomixer, a homogenizer, an ultrasonic disperser, or a wet ball mill.

The preferred blending amount of each component in the production method of an etchant of the present disclosure may be the same as the preferred blending amount of each component in the etchant composition of the present disclosure, as described above.

In the context of the present disclosure, in one or more embodiments, the "blending amount of each component in the etchant composition" means the amount of each component in the etchant composition that is to be used in the etching process, i.e., the amount of each component in the etchant composition at the time the etchant composition starts to be used in an etching treatment (at the time of use).

In one or more embodiments, the blending amount of each component in the etchant composition of the present disclosure may be considered as the content of each component in the etchant composition. However, the blending amount of each component may differ from the content of each component depending on the effect of neutralization.

An embodiment of the etchant composition of the present disclosure may be either a so-called one-part or two-part etchant composition. The one part etchant composition is supplied to the market with all the components being mixed together. On the other hand, the components of the two-part etchant composition are mixed at the time of use. An embodiment of the two-part etchant composition may include a solution (first solution) containing an etching inhibitor and an acid aqueous solution (second solution) containing a nitric acid. The first solution and the second solution may be mixed at the time of use. The acid contained in the second solution may correspond to the whole or part of the amount of the acid used for the preparation of the etchant composition. The first solution may contain an acid. Each of the first solution and the second solution may contain the above optional components as needed.

The pH of the etchant composition of the present disclosure is 1 or less, preferably 0 or less, more preferably less than 0, and further preferably about −1 from the viewpoint of reducing etching nonuniformity. The pH of the etchant composition may be −5 or more or −3 or more. In the present disclosure, the pH of the etchant composition is a value at a temperature of 25° C. and can be measured with a pH meter. Specifically, the pH of the etchant composition can be measured by a method as described in Examples.

The etchant composition of the present disclosure may be concentrated so as not to impair the stability, and stored and supplied in the concentrated state. This can reduce the production and transportation costs. If necessary, the concentrated solution may be appropriately diluted with water or an acid aqueous solution and used in the etching process. The dilution factor may be, e.g., 5 to 100.

[Kit]

In another aspect, the present disclosure relates to a kit (also referred to as a "kit of the present disclosure" in the following) for producing the etchant composition of the present disclosure.

A kit of the present disclosure may be, e.g., a kit (two-part etchant) that includes a solution (first solution) containing an etching inhibitor and an acid aqueous solution (second solution) containing at least a nitric acid so that the two solutions are not mixed with each other. The first solution and the second solution are mixed at the time of use. After the first solution and the second solution are mixed together, the mixed solution may be diluted with water or an acid aqueous solution as needed. The first solution or the second solution may contain the whole or part of the amount of water used for the preparation of the etchant. The acid contained in the second solution may correspond to the whole or part of the amount of the acid used for the preparation of the etchant. The first solution may contain an acid. Each of the first solution and the second solution may contain the above optional components as needed. The kit of the present disclosure can provide an etchant capable of reducing etching nonuniformity.

[Layer to be Etched]

In one or more embodiments, the layer to be etched with the etchant composition of the present disclosure contains at least one metal. Any metal can be used as long as the effects of the present invention are obtained. For example, the metal may be at least one selected from the group consisting of tungsten, tantalum, zirconium, hafnium, molybdenum, niobium, ruthenium, osmium, rhenium, rhodium, copper, nickel, cobalt, titanium, titanium nitride, alumina, aluminum, and iridium. In one or more embodiments, the etchant composition of the present disclosure is preferably used to etch the layer to be etched that contains at least one metal selected from the group consisting of tungsten, molybdenum, niobium, tantalum, and zirconium. Further, in one or more embodiments, the etchant composition is preferably used to etch a tungsten film or a molybdenum film. Thus, in one or more embodiments, the layer to be etched may be a tungsten film or a molybdenum film.

In one or more embodiments, the etchant composition of the present disclosure is preferably used to etch the layer to be etched that contains at least one metal selected from the group consisting of tungsten, molybdenum, copper, nickel, cobalt, and titanium. Further, in one or more embodiments, the etchant composition is preferably used to etch a tungsten film, a molybdenum film, a copper film, a nickel film, a cobalt film, or a titanium film. Thus in one or more embodiments, the layer to be etched may be a tungsten film, a molybdenum film, a copper film, a nickel film, a cobalt film, or a titanium film.

[Etching Method]

In one aspect, the present disclosure relates to an etching method (also referred to as an "etching method of the present disclosure" in the following). The etching method of the present disclosure includes etching a layer to be etched that contains at least one metal with the etchant composition of the present disclosure (also referred to as an "etching process of the present disclosure" in the following). In one or more embodiments, the use of the etching method of the present disclosure can reduce etching nonuniformity.

Examples of the etching treatment in the etching process of the present disclosure include immersion etching and single wafer etching.

In one or more embodiments, when the layer to be etched is a tungsten film, the temperature (etching temperature) of the etchant composition in the etching process of the present disclosure is preferably 0° C. or more, more preferably 50° C. or more, and further preferably 70° C. or more from the viewpoint of reducing etching nonuniformity. Furthermore, the temperature of the etchant composition is preferably 150° C. or less, more preferably 130° C. or less, and further preferably 110° C. or less. More specifically, in one or more embodiments, when the layer to be etched is a tungsten film, the etching temperature is preferably 0° C. or more and 150° C. or less, more preferably 50° C. or more and 130° C. or less, and further preferably 70° C. or more and 110° C. or less.

In one or more embodiments, when the layer to be etched is a molybdenum film, the temperature (etching temperature) of the etchant composition in the etching process of the present disclosure is preferably 0° C. or more, more preferably 15° C. or more, and further preferably 25° C. or more from the viewpoint of reducing etching nonuniformity. Furthermore, the temperature of the etchant composition is preferably 80° C. or less, more preferably 65° C. or less and further preferably 50° C. or less. More specifically, in one or more embodiments, when the layer to be etched is a molybdenum film, the etching temperature is preferably 0° C. or more and 80° C. or less, more preferably 15° C. or more and 65° C. or less, and further preferably 25° C. or more and 50° C. or less.

In one or more embodiments, when the layer to be etched is a nickel film, the temperature (etching temperature) of the etchant composition in the etching process of the present disclosure is preferably 0° C. or more, more preferably 15° C. or more, and further preferably 30° C. or more from the viewpoint of reducing etching nonuniformity. Furthermore, the temperature of the etchant composition is preferably 80° C. or less, more preferably 65° C. or less, and further preferably 50° C. or less. More specifically, in one or more embodiments, when the layer to be etched is a nickel film, the etching temperature is preferably 0° C. or more and 80° C. or less more preferably 15° C. or more and 65° C. or less, and further preferably 30° C. or more and 50° C. or less.

In one or more embodiments, when the layer to be etched is a cobalt film, the temperature (etching temperature) of the etchant composition in the etching process of the present disclosure is preferably 0° C. or more, more preferably 15° C. or more, and further preferably 30° C. or more from the viewpoint of reducing etching nonuniformity. Furthermore, the temperature of the etchant composition is preferably 80° C. or less, more preferably 65° C. or less, and further preferably 50° C. or less. More specifically, in one or more embodiments, when the layer to be etched is a cobalt film, the etching temperature is preferably 0° C. or more and 80° C. or less, more preferably 15° C. or more and 65° C. or less, and further preferably 30° C. or more and 50° C. or less.

In one or more embodiments, when the layer to be etched is a titanium film, the temperature (etching temperature) of the etchant composition in the etching process of the present disclosure is preferably 0° C. or more, more preferably 50° C. or more, and further preferably 70° C. or more from the viewpoint of reducing etching nonuniformity. Furthermore, the temperature of the etchant composition is preferably 150° C. or less, more preferably 130° C. or less, and further preferably 110° C. or less. More specifically, in one or more embodiments, when the layer to be etched is a titanium film, the etching temperature is preferably 0° C. or more and 150° C. or less, more preferably 50° C. or more and 130° C. or less, and further preferably 70° C. or more and 110° C. or less.

In one or more embodiments, when the layer to be etched is a copper film, the temperature (etching temperature) of the etchant composition in the etching process of the present disclosure is preferably 0° C. or more, more preferably 15° C. or more, and further preferably 30° C. or more from the viewpoint of reducing etching nonuniformity. Furthermore, the temperature of the etchant composition is preferably 80° C. or less, more preferably 65° C. or less, and further preferably 50° C. or less. More specifically, in one or more embodiments, when the layer to be etched is a copper film, the etching temperature is preferably 0° C. or more and 80° C. or less, more preferably 15° C. or more and 65° C. or less, and further preferably 30° C. or more and 50° C. or less.

In the etching process of the present disclosure, the etching time may be set to, e.g., 1 minute or more and 180 minutes or less.

In one or more embodiments, when the layer to be etched is a tungsten film, the etching rate in the etching process of the present disclosure is preferably 0.0001 g/min or more, more preferably 0.0005 g/min or more, and further preferably 0.001 g/min or more from the viewpoint of improving productivity. Furthermore, the etching rate is preferably 10 g/min or less, more preferably 1 g/min or less, and further preferably 0.1 g/min or less from the viewpoint of reducing etching nonuniformity.

In one or more embodiments, when the layer to be etched is a molybdenum film, the etching rate in the etching process of the present disclosure is preferably 0.01 g/min or more, more preferably 0.03 g/min or more, and further preferably 0.05 g/min or more from the viewpoint of improving productivity. Furthermore, the etching rate is preferably 10 g/min or less, more preferably 3 g/min or less, and further preferably 1 g/min or less from the viewpoint of reducing etching nonuniformity.

In one or more embodiments, when the layer to be etched is a nickel film, the etching rate in the etching process of the present disclosure is preferably 0.001 g/min or more, more preferably 0.005 g/min or more, and further preferably 0.01 g/min or more from the viewpoint of improving productivity. Furthermore, the etching rate is preferably 10 g/min or less, more preferably 1 g/min or less, and further preferably 0.5 g/min or less from the viewpoint of reducing etching nonuniformity.

In one or more embodiments, when the layer to be etched is a cobalt film, the etching rate in the etching process of the present disclosure is preferably 0.0001 g/min or more, more preferably 0.0005 g/min or more, and further preferably 0.001 g/min or more from the viewpoint of improving productivity. Furthermore, the etching rate is preferably 10 g/min or less, more preferably 1 g/min or less, and further preferably 0.1 g/min or less from the viewpoint of reducing etching nonuniformity.

In one or more embodiments, when the layer to be etched is a titanium film, the etching rate in the etching process of the present disclosure is preferably 0.00001 g/min or more, more preferably 0.0005 g/min or more, and further preferably 0.001 g/min or more from the viewpoint of improving productivity. Furthermore, the etching rate is preferably 10 g/min or less, more preferably 3 g/min or less and further preferably 1 g/min or less from the viewpoint of reducing etching nonuniformity.

In one or more embodiments, when the layer to be etched is a copper film, the etching rate in the etching process of the present disclosure is preferably 0.0001 g/min or more, more preferably 0.0005 g/min or more, and further preferably 0.001 g/min or more from the viewpoint of improving productivity. Furthermore, the etching rate is preferably 10 g/min or less more preferably 1 g/min or less, and further preferably 0.1 g/min or less from the viewpoint of reducing etching nonuniformity.

In one or more embodiments, the etchant composition and the etching method of the present disclosure can be used to etch metals in the manufacturing process of electronic devices, particularly semiconductor wafers.

In one or more embodiments, the etchant composition and the etching method of the present disclosure can be suitably used for the production of semiconductor wafers. This can improve not only etching nonuniformity, but also productivity and yield.

In one or more embodiments, the etchant composition and the etching method of the present disclosure can be used to etch electrodes in the manufacturing process of electronic devices, particularly semiconductor memories such as nonvolatile memories including NAND flash memories.

In one or more embodiments, the etchant composition and the etching method of the present disclosure can be suitably used for the production of three-dimensional structure patterns. This can provide sophisticated devices such as large-capacity memories.

The etchant composition and the etching method of the present disclosure can be used for the etching method as disclosed in, e.g., JP 2020-145412 A.

EXAMPLES

Hereinafter, the present disclosure will be described in detail by way of examples. However, the present disclosure is not limited to the following examples.

1. Preparation of Etchant

Examples 1 TO 9

Etchants (pH: −1) of Examples 1 to 9 were prepared by blending the etching inhibitor, the mixed acid (phosphoric acid/acetic acid/nitric acid, mass ratio: 88/8/4), and water, as shown in Table 1. The mass ratio of the mixed acid is expressed in terms of mass.

Comparative Example 1

An etchant of Comparative Example 1 was a mixed acid aqueous solution (pH: −1) prepared by blending a phosphoric acid, an acetic acid, a nitric acid, and water at a mass ratio (phosphoric acid/acetic acid/nitric acid/water) 76/7/3/14.

Comparative Example 2

An etchant (pH: −1) of Comparative Example 2 was prepared by blending the nitrogen-containing compound (arginine), the mixed acid (phosphoric acid/acetic acid/nitric acid, mass ratio: 88/8/4), and water, as shown in Table 1.

Comparative Example 3

An etchant (pH: −1) of Comparative Example 3 was prepared by blending the etching inhibitor (polyethyleneimine), hydrogen peroxide, a phosphoric acid, and water, as shown in Table 1.

Table 1 shows the blending amount (% by mass, active part) of each component in each of the etchants thus prepared. In Table 1, the blending amount of water also includes the amount of water contained in, e.g., the acid aqueous solution or the hydrogen peroxide solution.

The etchants were prepared by using the following components.

(Etching Inhibitor or Nitrogen-Containing Compound)

Polyethyleneimine [number average molecular weight: 300, "EPOMIN SP-003" manufactured by NIPPON SHOKUBAI CO., LTD.]

Polyethyleneimine [number average molecular weight: 600, "EPOMIN SP-006" manufactured by NIPPON SHOKUBAI CO., LTD.]

Polyethyleneimine [number average molecular weight: 1,200, "EPOMIN SP-0012" manufactured by NIPPON SHOKUBAI CO., LTD.]

Polyethyleneimine [number average molecular weight: 1,800, "EPOMIN SP-018" manufactured by NIPPON SHOKUBAI CO., LTD.]

Polyethyleneimine [number average molecular weight: 10,000, "EPOMIN SP-200" manufactured by NIPPON SHOKUBAI CO., LTD.]

Polyethyleneimine [number average molecular weight: 70,000, "EPOMIN P-1000" manufactured by NIPPON SHOKUBAI CO., LTD.]

Dialylamine acetate/sulfur dioxide copolymer [molar ratio 50/50, weight average molecular weight: 5,000, "PAS-92A" manufactured by NITTOBO MEDICAL CO., LTD.]

N-(2-hydroxyethyl)piperazine [molecular weight: 130, manufactured by NIPPON NYUKAZAI CO., LTD.]

DL-arginine [molecular weight: 174, manufactured by FUJIFILM Wako Pure Chemical Corporation]

(Hydrogen Peroxide)

$H_2O_2$ [hydrogen peroxide, concentration: 35% by mass, manufactured by ADEKA Corporation]

(Acid)

Phosphoric acid [concentration: 85%, manufactured by RIN KAGAKU KOGYO CO., LTD.]

Acetic acid [concentration: 100%, manufactured by FUJIFILM Wako Pure Chemical Corporation]

Nitric acid [concentration: 70%, manufactured by FUJIFILM Wako Pure Chemical Corporation]

(Water)

Water [ultrapure water produced by using a continuous pure water production system (PURECONTI PC-2000VRL) and a subsystem (MAKUACE KC-05H), both manufactured by Kurita Water Industries Ltd.]

2. Method for Measuring Each Parameter

[pH of Etchant]

The pH value of the etchant at 25° C. was measured with a pH meter (manufactured by DKK-TOA CORPORATION). Specifically, the pH value was obtained 1 minute after the electrode of the pH meter was immersed in the etchant.

3-1. Evaluation of Etchant (Layer to be Etched: Tungsten Plate)

[Evaluation of Etching Rate and Percentage of Etching Inhibition of Tungsten Plate]

A tungsten plate in the form of a plate of 2 cm long 2 cm wide, and 0.1 mm thick was weighed in advance and immersed in each of the etchants (Examples 1 to 9 and Comparative Examples 1 to 3) that had been prepared with their respective compositions. The tungsten plate was etched at 90° C. for 120 minutes. Then, the tungsten plate was washed with water and subsequently weighed again. The difference in weight of the tungsten plate was defined as an etching amount. A precision balance was used to measure the weight.

The etching rate of the tungsten plate was determined by the following formula:

$$\text{Etching rate (g/min)} = \text{etching amount (g)} / \text{etching time (min)}$$

Table 1 shows the etching rate of the tungsten plate as a relative value (relative rate) with respect to the etching rate of Comparative Example 1, which is taken as 100. Table 1 also shows the percentage of etching inhibition (%) calculated by subtracting the relative rate from 100 for each of the Examples and Comparative Examples, where the relative rate is obtained with respect to the etching rate of Comparative Example 1, which is taken as 100.

The etching rate and the percentage of etching inhibition may be evaluated using a molybdenum plate of 2 cm long, 2 cm wide, and 0.1 mm thick or a wafer illustrated in FIG. 1 of JP 2020-145412 A, instead of the tungsten plate of 2 cm long 2 cm wide, and 0.1 mm thick.

[Evaluation of Etching Nonuniformity (Profile Irregularity) of Tungsten Plate]

A tungsten plate of 2 cm long 2 cm wide, and 0.1 mm thick was weighed in advance and immersed in each of the etchants (Examples 1 to 9 and Comparative Examples 1 to 3) that had been prepared with their respective compositions. The tungsten plate was etched at 90° C. for 120 minutes. After the tungsten plate was washed with water, the surface of the tungsten plate was observed again with a 3D profile laser microscope VK-9710 (150× lens magnification) manufactured by KEYENCE CORPORATION. The resulting micrographs were analyzed in a surface-roughness mode of this microscope, and the profile irregularity (etching nonuniformity) was determined. The profile irregularity of the tungsten plate was evaluated based on the following evaluation criteria. Table 1 shows the results.

$$\text{Profile irregularity (\%)} = \text{surface roughness after etching} / \text{surface roughness before etching} \times 100$$

<Evaluation Criteria>

5: profile irregularity of less than 120%

4: profile irregularity of 120% or more and less than 200%

3: profile irregularity of 200% or more and less than 300%

2: profile irregularity of 300% or more and less than 500%

1: profile irregularity of 500% or more and less than 700%

0: profile irregularity of 700% or more

The etching nonuniformity may be evaluated using a molybdenum plate of 2 cm long 2 cm wide, and 0.1 mm thick or a wafer illustrated in FIG. 1 of JP 2020-145412 A, instead of the tungsten plate of 2 cm long, 2 cm wide, and 0.1 mm thick.

[Zeta Potential]

Samples for zeta potential measurement were prepared by adding a 100 ppm standard solution of tungsten to each of the etchants (Examples 1 to 9 and Comparative Examples 1 to 3) that had been prepared with their respective compositions. A precision balance was used to measure the weight.

Each sample was placed in a capillary cell DTS1070 to measure a zeta potential with "Zetasizer Nano ZS" manufactured by Malvern Panalytical Ltd. under the following conditions.

<Measurement Conditions>

Tungsten: refractive index 2.200, absorptance 0.390

Dispersion medium: viscosity 39 cP, refractive index 1.426

Temperature: 25° C.

Examples 1 to 9, in which the etchant contained both the etching inhibitor and the mixed acid (including a nitric acid), as compared to Comparative Examples 1 and 2, in which the etchant did not contain the etching inhibitor, and Comparative Example 3, in which the etchant contained an acid other than a nitric acid.

Further, the etchants of Examples 1, 3 to 4 and the etchants of Comparative Examples 1 to 3 were used to make the following evaluation.

3-2. Evaluation of Etchant (Layer to be Etched: Nickel Plate)

[Evaluation of Etching Rate and Percentage of Etching Inhibition of Nickel Plate]

A nickel plate of 2 cm long 2 cm wide, and 0.1 mm thick was used instead of the tungsten plate and etched in the same manner as the tungsten plate except that the etching conditions were changed: the etching temperature was 40° C. and

TABLE 1

| | Composition | | | | |
|---|---|---|---|---|---|
| | Acid | | Water | Etching inhibitor or nitrogen-containing compound | |
| | Type | Blending amount (mass %) | Blending amount (mass %) | Type | Number average molecular weight or weight average molecular weight |
| Ex. 1 | mixed acid | 85.0 | 14.0 | polyethyleneimine | 300 |
| Ex. 2 | mixed acid | 85.0 | 14.0 | polyethyleneimine | 600 |
| Ex. 3 | mixed acid | 85.0 | 14.0 | polyethyleneimine | 1,800 |
| Ex. 4 | mixed acid | 85.0 | 14.0 | polyethyleneimine | 70,000 |
| Ex. 5 | mixed acid | 85.8 | 14.1 | polyethylenelmine | 1,800 |
| Ex. 6 | mixed acid | 85.4 | 14.1 | polyethyleneimine | 1,800 |
| Ex. 7 | mixed acid | 84.1 | 13.9 | polyethyleneimine | 1,800 |
| Ex. 8 | mixed acid | 85.0 | 14.0 | diallylamine/sulfur dioxide copolymer | 5,000 |
| Ex. 9 | mixed acid | 84.1 | 13.9 | polyethyleneimine<br>N-(2-hydroxyethyl)piperazine | 1.800<br>molecular weight 130 |
| Comp. Ex. 1 | mixed acid | 86.0 | 14.0 | — | — |
| Comp. Ex. 2 | mixed acid | 85.0 | 14.0 | arginine | molecular weight 174 |
| Comp. Ex. 3 | phosphoric acid | 70.2 | 26.15 | polyethyleneimine | 70,000 |

| | Composition | | | Result | | | |
|---|---|---|---|---|---|---|---|
| | Etching inhibitor or nitrogen-containing compound | | | Etching rate of | Percentage | | Evaluation of etching |
| | Blending amount (mass %) | Monomer unit with ring structure | Hydrogen peroxide Blending amount (mass %) | tungsten plate (%) (relative value) | of etching inhibition of tungsten plate (%) | Zeta potential (mV) | nonuniformity Evaluation of Profile irregularity |
| Ex. 1 | 1.0 | No | — | 14 | 86 | 21 | 4 |
| Ex. 2 | 1.0 | No | — | 6 | 94 | 28 | 5 |
| Ex. 3 | 1.0 | No | — | 4 | 96 | 29 | 5 |
| Ex. 4 | 1.0 | Nc | — | 10 | 90 | 29 | 4 |
| Ex. 5 | 0.1 | No | — | 9 | 91 | 22 | 4 |
| Ex. 6 | 0.5 | No | — | 6 | 94 | 25 | 5 |
| Ex. 7 | 2.0 | No | — | 3 | 97 | 30 | 5 |
| Ex. 8 | 1.0 | Yes | — | 24 | 76 | 5 | 3 |
| Ex. 9 | 1.0<br>1.0 | No<br>Yes | —<br>— | 3 | 97 | 30 | 5 |
| Comp. Ex. 1 | — | No | — | 100 | 0 | −6 | 0 |
| Comp. Ex. 2 | 1.0 | No | — | 71 | 29 | −3 | 2 |
| Comp. Ex. 3 | 0.05 | No | 3.6 | 11 | 89 | 28 | 1 |

As shown in Table 1, the etching rate of the tungsten plate was decreased and the etching nonuniformity was reduced in the etching time was 10 minutes. The etching rate of the nickel plate was measured and the result was shown in Table 2. Table 2 also shows the percentage of etching inhibition (%) calculated by subtracting the relative rate from 100 for each of the Examples and Comparative Examples, where the relative rate is obtained with respect to the etching rate of Comparative Example 1, which is taken as 100.

[Evaluation of Etching Nonuniformity (Profile Irregularity) of Nickel Plate]

A nickel plate of 2 cm long, 2 cm wide, and 0.1 mm thick was weighed in advance and immersed in each of the etchants (Examples 1, 3 to 4 and Comparative Examples 1 to 3) that had been prepared. The nickel plate was etched at 40° C. for 10 minutes. After the nickel plate was washed with water, the surface of the nickel plate was observed again with a 3D profile laser microscope VK-9710 (150× lens magnification) manufactured by KEYENCE CORPORATION. The resulting micrographs were analyzed in a surface roughness mode of this microscope, and the profile irregularity (etching nonuniformity) was determined. The profile irregularity of the nickel plate was evaluated based on the same criteria as that for evaluating the profile irregularity of the tungsten plate. Table 2 shows the results.

TABLE 2

| | Composition | | | | |
|---|---|---|---|---|---|
| | Acid | | Water | Etching inhibitor or nitrogen-containing compound | |
| | Type | Blending amount (mass %) | Blending amount (mass %) | Type | Number average molecular weight |
| Ex. 1 | mixed acid | 85.0 | 14.0 | polyethyleneimine | 300 |
| Ex. 3 | mixed acid | 85.0 | 14.0 | polyethyleneimine | 1,800 |
| Ex. 4 | mixed acid | 85.0 | 14.0 | polyethyleneimine | 70,000 |
| Comp. Ex. 1 | mixed acid | 86.0 | 14.0 | — | — |
| Comp. Ex. 2 | mixed acid | 85.0 | 14.0 | arginine | molecular weight 174 |
| Comp. Ex. 3 | phosphoric acid | 70.2 | 26.15 | polyethyleneimine | 70,000 |

| | Composition | | | Result | | |
|---|---|---|---|---|---|---|
| | Etching inhibitor or nitrogen-containing compound | | Hydrogen | Etching rate of | Percentage | Evaluation of etching |
| | Blending amount (mass %) | Monomer unit with ring structure | peroxide Blending amount (mass %) | nickel plate (%) (relative value) | of etching inhibition of nickel plate (%) | nonuniformity Evaluation of Profile irregularity |
| Ex. 1 | 1.0 | No | — | 12 | 88 | 4 |
| Ex. 3 | 1.0 | No | — | 3 | 97 | 5 |
| Ex. 4 | 1.0 | No | — | 10 | 90 | 4 |
| Comp. Ex. 1 | — | No | — | 100 | 0 | 0 |
| Comp. Ex. 2 | 1.0 | No | — | 87 | 13 | 2 |
| Comp. Ex. 3 | 0.05 | No | 3.6 | 21 | 79 | 1 |

As shown in Table 2, the etching nonuniformity was reduced in Examples 1, 3 to 4, in which the etchant contained both the etching inhibitor and the mixed acid (including a nitric acid), as compared to Comparative Examples 1 and 2, in which the etchant did not contain the etching inhibitor, and Comparative Example 3, in which the etchant contained an acid other than a nitric acid.

3-3 Evaluation of Etchant (Layer to be Etched: Cobalt Plate)

[Evaluation of Etching Rate and Percentage of Etching Inhibition of Cobalt Plate]

A cobalt plate of 2 cm long: 2 cm wide, and 0.1 mm thick was used instead of the tungsten plate and etched in the same manner as the tungsten plate except that the etching conditions were changed: the etching temperature was 40° C. and the etching time was 10 minutes. The etching rate of the cobalt plate was measured and the result was shown in Table 3. Table 3 also shows the percentage of etching inhibition (%) calculated by subtracting the relative rate from 100 for each of the Examples and Comparative Examples, where the relative rate is obtained with respect to the etching rate of Comparative Example 1, which is taken as 100.

[Evaluation of Etching Nonuniformity (Profile Irregularity) of Cobalt Plate]

A cobalt plate of 2 cm long 2 cm wide, and 0.1 mm thick was weighed in advance and immersed in each of the etchants (Examples 1, 3 to 4 and Comparative Examples 1 to 3) that had been prepared. The cobalt plate was etched at 40° C. for 10 minutes. After the cobalt plate was washed with water, the surface of the cobalt plate was observed again with a 3D profile laser microscope VK-9710 (150× lens magnification) manufactured by KEYENCE CORPORATION. The resulting micrographs were analyzed in a surface-roughness mode of this microscope, and the profile irregularity (etching nonuniformity) was determined. The profile irregularity of the cobalt plate was evaluated based on the same criteria as that for evaluating the profile irregularity of the tungsten plate. Table 3 shows the results.

TABLE 3

| | Composition | | | | |
|---|---|---|---|---|---|
| | Acid | | Water | Etching inhibitor or nitrogen-containing compound | |
| | Type | Blending amount (mass %) | Blending amount (mass %) | Type | Number average molecular weight |
| Ex. 1 | mixed acid | 85.0 | 14.0 | polyethyleneimine | 300 |
| Ex. 3 | mixed acid | 85.0 | 14.0 | polyethyleneimine | 1,800 |
| Ex. 4 | mixed acid | 85.0 | 14.0 | polyethyleneimine | 70,000 |
| Comp. Ex. 1 | mixed acid | 86.0 | 14.0 | — | — |
| Comp. Ex. 2 | mixed acid | 85.0 | 14.0 | arginine | molecular weight 174 |
| Comp. Ex. 3 | phosphoric acid | 70.2 | 26.15 | polyethyleneimine | 70,000 |

| | Composition | | | Result | | |
|---|---|---|---|---|---|---|
| | Etching inhibitor or nitrogen-containing compound | | Hydrogen | Etching rate of | Percentage | Evaluation of etching |
| | Blending amount (mass %) | Monomer unit with ring structure | peroxide Blending amount (mass %) | cobalt plate (%) (relative value) | of etching inhibition of cobalt plate (%) | nonuniformity Evaluation of Profile irregularity |
| Ex. 1 | 1.0 | No | — | 76 | 24 | 3 |
| Ex. 3 | 1.0 | No | — | 55 | 45 | 4 |
| Ex. 4 | 1.0 | No | — | 60 | 40 | 3 |
| Comp. Ex. 1 | — | No | — | 100 | 0 | 0 |
| Comp. Ex. 2 | 1.0 | No | — | 97 | 3 | 2 |
| Comp. Ex. 3 | 0.05 | No | 3.6 | 55 | 45 | 1 |

As shown in Table 3, the etching nonuniformity was reduced in Examples 1, 3 to 4, in which the etchant contained both the etching inhibitor and the mixed acid (including a nitric acid), as compared to Comparative Examples 1 and 2, in which the etchant did not contain the etching inhibitor, and Comparative Example 3, in which the etchant contained an acid other than a nitric acid.

3-4 Evaluation of Etchant (Layer to be Etched: Titanium Plate)

[Evaluation of Etching Rate and Percentage of Etching Inhibition of Titanium Plate]

A titanium plate of 2 cm long, 2 cm wide, and 0.1 mm thick was used instead of the tungsten plate and etched in the same manner as the tungsten plate. The etching rate of the titanium plate was measured and the result was shown in Table 4. Table 4 also shows the percentage of etching inhibition (%) calculated by subtracting the relative rate from 100 for each of the Examples and Comparative Examples, where the relative rate is obtained with respect to the etching rate of Comparative Example 1, which is taken as 100.

[Evaluation of Etching Nonuniformity (Profile Irregularity) of Titanium Plate]

A titanium plate of 2 cm long, 2 cm wide, and 0.1 mm thick was weighed in advance and immersed in each of the etchants (Examples 1, 3 to 4 and Comparative Examples 1 to 3) that bad been prepared. The titanium plate was etched at 90° C. for 120 minutes. After the titanium plate was washed with water, the surface of the titanium plate was observed again with a 3D profile laser microscope VK-9710 (150× lens magnification) manufactured by KEYENCE CORPORATION. The resulting micrographs were analyzed in a surface-roughness mode of this microscope, and the profile irregularity (etching nonuniformity) was determined. The profile irregularity of the titanium plate was evaluated based on the same criteria as that for evaluating the profile irregularity of the tungsten plate. Table 4 shows the results.

TABLE 4

| | Composition | | | | |
|---|---|---|---|---|---|
| | Acid | | Water | Etching inhibitor or nitrogen-containing compound | |
| | Type | Blending amount (mass %) | Blending amount (mass %) | Type | Number average molecular weight |
| Ex. 1 | mixed acid | 85.0 | 14.0 | polyethyleneimine | 300 |
| Ex. 3 | mixed acid | 85.0 | 14.0 | polyethyleneimine | 1,800 |
| Ex. 4 | mixed acid | 85.0 | 14.0 | polyethyleneimine | 70,000 |

TABLE 4-continued

| | | | | | |
|---|---|---|---|---|---|
| Comp. Ex. 1 | mixed acid | 86.0 | 14.0 | — | — |
| Comp. Ex. 2 | mixed acid | 85.0 | 14.0 | arginine | molecular weight 174 |
| Comp. Ex. 3 | phosphoric acid | 70.2 | 26.15 | polyethyleneimine | 70,000 |

| | Composition | | | Result | | |
|---|---|---|---|---|---|---|
| | Etching inhibitor or nitrogen-containing compound | | Hydrogen | Etching rate of | Percentage | Evaluation of etching |
| | Blending amount (mass %) | Monomer unit with ring structure | peroxide Blending amount (mass %) | titanium plate (%) (relative value) | of etching inhibition of titanium plate (%) | nonuniformity Evaluation of Profile irregularity |
| Ex. 1 | 1.0 | No | — | 28 | 72 | 3 |
| Ex. 3 | 1.0 | No | — | 17 | 83 | 5 |
| Ex. 4 | 1.0 | No | — | 21 | 79 | 4 |
| Comp. Ex. 1 | — | No | — | 100 | 0 | 0 |
| Comp. Ex. 2 | 1.0 | No | — | 93 | 7 | 2 |
| Comp. Ex. 3 | 0.05 | No | 3.6 | 27 | 73 | 1 |

As shown in Table 4, the etching nonuniformity was reduced in Examples 1, 3 to 4, in which the etchant contained both the etching inhibitor and the mixed acid (including a nitric acid), as compared to Comparative Examples 1 and 2, in which the etchant did not contain the etching inhibitor, and Comparative Example 3, in which the etchant contained an acid other than a nitric acid.

3-5 Evaluation of Etchant (Layer to be Etched: Copper Plate)

[Evaluation of Etching Rate and Percentage of Etching Inhibition of Copper Plate]

A copper plate of 2 cm long, 2 cm wide, and 0.1 mm thick was used instead of the tungsten plate and etched in the same manner as the tungsten plate except that the etching conditions were changed: the etching temperature was 40° C. and the etching time was 10 minutes. The etching rate of the copper plate was measured and the result was shown in Table 5. Table 5 also shows the percentage of etching inhibition (%) calculated by subtracting the relative rate from 100 for each of the Examples and Comparative Examples, where the relative rate is obtained with respect to the etching rate of Comparative Example 1, which is taken as 100.

[Evaluation of Etching Nonuniformity (Profile Irregularity) of Cobalt Plate]

A copper plate of 2 cm long, 2 cm wide, and 0.1 mm thick was weighed in advance and immersed in each of the etchants (Examples 1, 3 to 4 and Comparative Examples 1 to 3) that had been prepared. The copper plate was etched at 40° C. for 10 minutes. After the copper plate was washed with water, the surface of the copper plate was observed again with a 3D profile laser microscope VK-9710 (150× lens magnification) manufactured by KEYENCE CORPORATION. The resulting micrographs were analyzed in a surface-roughness mode of this microscope, and the profile irregularity (etching nonuniformity) was determined. The profile irregularity of the copper plate was evaluated based on the same criteria as that for evaluating the profile irregularity of the tungsten plate. Table 5 shows the results.

TABLE 5

| | Composition | | | | |
|---|---|---|---|---|---|
| | Acid | | Water | Etching inhibitor or nitrogen-containing compound | |
| | Type | Blending amount (mass %) | Blending amount (mass %) | Type | Number average molecular weight |
| Ex. 1 | mixed acid | 85.0 | 14.0 | polyethyleneimine | 300 |
| Ex. 3 | mixed acid | 85.0 | 14.0 | polyethyleneimine | 1,800 |
| Ex. 4 | mixed acid | 85.0 | 14.0 | polyethyleneimine | 70,000 |
| Comp. Ex. 1 | mixed acid | 86.0 | 14.0 | — | — |
| Comp. Ex. 2 | mixed acid | 85.0 | 14.0 | arginine | molecular weight 174 |
| Comp. Ex. 3 | phosphoric acid | 70.2 | 26.15 | polyethyleneimine | 70,000 |

TABLE 5-continued

| | Composition | | | Result | | |
|---|---|---|---|---|---|---|
| | Etching inhibitor or nitrogen-containing compound | | Hydrogen | Etching rate of | Percentage | Evaluation of etching |
| | Blending amount (mass %) | Monomer unit with ring structure | peroxide Blending amount (mass %) | copper plate (%) (relative value) | of etching inhibition of copper plate (%) | nonuniformity Evaluation of Profile irregularity |
| Ex. 1 | 1.0 | No | — | 55 | 45 | 3 |
| Ex. 3 | 1.0 | No | — | 42 | 58 | 4 |
| Ex. 4 | 1.0 | No | — | 49 | 51 | 3 |
| Comp. Ex. 1 | — | No | — | 100 | 0 | 0 |
| Comp. Ex. 2 | 1.0 | No | — | 92 | 8 | 2 |
| Comp. Ex. 3 | 0.05 | No | 3.6 | 56 | 44 | 1 |

As shown in Table 5, the etching nonuniformity was reduced in Examples 1, 3 to 4, in which the etchant contained both the etching inhibitor and the mixed acid (including a nitric acid), as compared to Comparative Examples 1 and 2, in which the etchant did not contain the etching inhibitor, and Comparative Example 3, in which the etchant contained an acid other than a nitric acid.

INDUSTRIAL APPLICABILITY

The etchant composition of the present disclosure is able to reduce etching nonuniformity and is useful in a method for producing a large-capacity semiconductor memory.

The invention claimed is:

1. An etchant composition for etching of a layer to be etched that contains molybdenum, the etchant composition comprising an etching inhibitor, an acid including a phosphoric acid, an acetic acid, and a nitric acid, and water and having a pH of 1 or less, wherein the etching inhibitor is polyalkyleneimine having an average molecular weight of 1,200 or more, a blending amount of the etching inhibitor is 0.1% by mass or more and 5% by mass or less.

2. The etchant composition according to claim 1, wherein the etchant composition does not contain hydrogen peroxide.

3. An etchant composition for an etching treatment of a layer to be etched that contains molybdenum, the etchant composition comprising an etching inhibitor, an acid including a phosphoric acid, an acetic acid, and a nitric acid, and water and having a pH of 1 or less, wherein the etching inhibitor has an average molecular weight of 1,200 or more and is a nitrogen-containing compound with a percentage of etching inhibition of 30% or more, which is determined under the following conditions:

the percentage of etching inhibition is calculated by subtracting a relative rate A from 100, where the relative rate A is obtained by determining an etching rate measured using the etchant composition with respect to an etching rate measured using a mixed acid aqueous solution, which is taken as 100; the mixed acid aqueous solution consists of a phosphoric acid, an acetic acid, a nitric acid, and water; a mass ratio of added amounts of the phosphoric acid, the acetic acid, and the nitric acid in the mixed acid aqueous solution is the same as that of added amounts of the phosphoric acid, the acetic acid, and the nitric acid in the etchant composition; a total added amount of the phosphoric acid, the acetic acid, and the nitric acid in the mixed acid aqueous solution is 86% by mass; and the mixed acid aqueous solution is used for etching at a predetermined temperature for a predetermined time so that the etching rate is measured.

4. An etching method comprising:

etching a layer to be etched that contains molybdenum with an etchant composition, the etchant composition comprising an etching inhibitor, an acid including a phosphoric acid, an acetic acid, and a nitric acid, and water and having a pH of 1 or less, wherein the etching inhibitor is polyalkyleneimine having an average molecular weight of 1,200 or more, a blending amount of the etching inhibitor is 0.1% by mass or more and 5% by mass or less.

5. The etching method according to claim 4, wherein the etchant composition does not contain hydrogen peroxide.

6. The etching method according to claim 4, wherein a zeta potential of a surface of the at least one metal contained in the layer to be etched is a negative value, provided that the pH is 1 or less.

7. An etching method comprising:

etching a layer to be etched that contains molybdenum with an etchant composition, the etchant composition comprising an etching inhibitor, an acid including a phosphoric acid, an acetic acid, and a nitric acid, and water and having a pH of 1 or less, wherein the etching inhibitor has an average molecular weight of 1,200 or more and is a nitrogen-containing compound with a percentage of etching inhibition of 30% or more, which is determined under the following conditions:

the percentage of etching inhibition is calculated by subtracting a relative rate A from 100, where the relative rate A is obtained by determining an etching rate measured using the etchant composition with respect to an etching rate measured using a mixed acid aqueous solution, which is taken as 100; the mixed acid aqueous solution consists of a phosphoric acid, an acetic acid, a nitric acid, and water; a mass ratio of added amounts of the phosphoric acid, the acetic acid, and the nitric acid in the mixed acid aqueous solution is the same as that of added amounts of the phosphoric acid, the acetic acid, and the nitric acid in the etchant composition; a total added amount of the phosphoric acid, the acetic acid, and the nitric acid in the mixed acid aqueous solution is 86% by mass; and the mixed acid aqueous solution is used for etching at a predetermined temperature for a predetermined time so that the etching rate is measured.

8. The etching method according to claim 7 wherein the etchant composition does not contain hydrogen peroxide.

9. The etching method according to claim 7, wherein a zeta potential of a surface of the at least one metal contained in the layer to be etched is a negative value, provided that the pH is 1 or less.

* * * * *